US005449244A

United States Patent [19]

Sandino

[11] Patent Number: 5,449,244

[45] Date of Patent: Sep. 12, 1995

[54] LIGHT REFLECTIVE PAVEMENT MARKER AND METHOD OF MAKING THE SAME

[76] Inventor: Hector Sandino, 12 Magellan, Irvine, Calif. 92720

[21] Appl. No.: 196,453

[22] Filed: Feb. 14, 1994

[51] Int. Cl.[6] ..... E01F 9/00

[52] U.S. Cl. ..... 404/14

[58] Field of Search ..... 404/9-16, 404/72, 73

[56] References Cited

U.S. PATENT DOCUMENTS

| | | | |
|---|---|---|---|
| 3,499,371 | 3/1970 | Jonnes et al. | 404/14 X |
| 4,653,955 | 3/1987 | Racs | 404/14 |
| 5,002,424 | 3/1991 | Hedgewick | 404/14 |
| 5,197,819 | 3/1993 | Hughes | 404/13 |
| 5,340,231 | 8/1994 | Steere et al. | 404/14 |

*Primary Examiner*—Michael Powell Buiz
*Attorney, Agent, or Firm*—Stetina Brunda & Buyan

[57] ABSTRACT

A reflective pavement marker having a generally circular dome-shaped configuration and method of manufacturing same. The marker comprises a first generally circular reflective member being received upon a second generally circular back plate member. A casing is molded about the circular members such that the casing rigidly sandwiches the circular members in unvarying position. Preferably, an injection mold is utilized to form the casing about the circular members.

16 Claims, 2 Drawing Sheets

Fig. 1
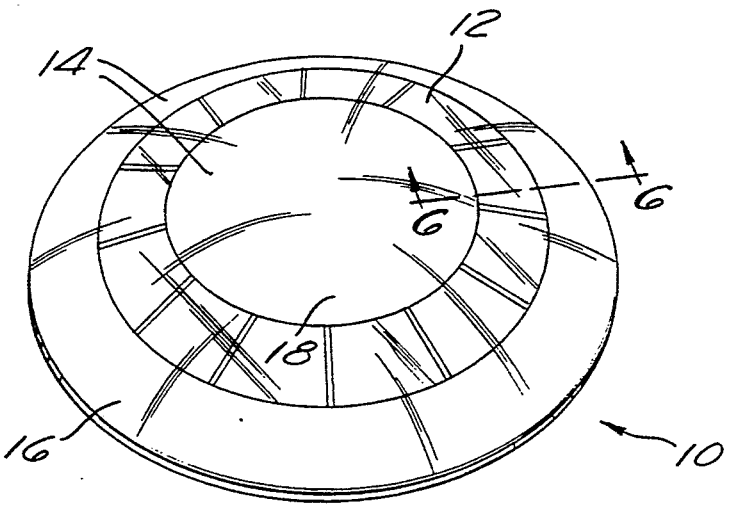
Fig. 2
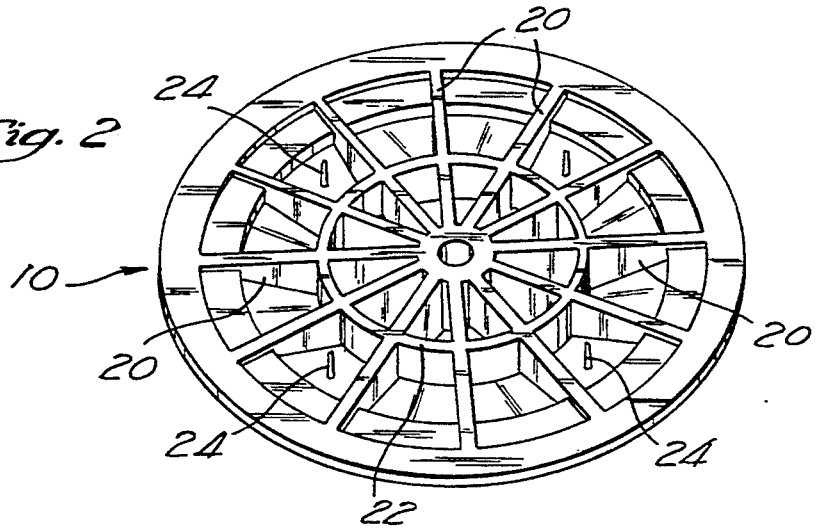
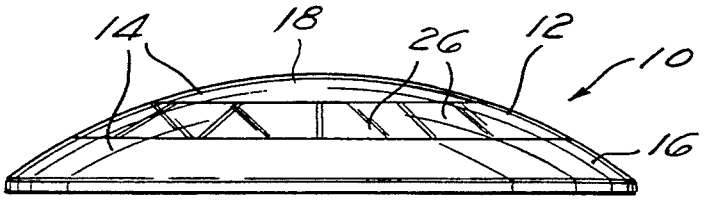
Fig. 3

LIGHT REFLECTIVE PAVEMENT MARKER AND METHOD OF MAKING THE SAME

FIELD OF THE INVENTION

The present invention relates generally to reflective pavement markers, and more particularly, to reflective pavement markers having a generally circular, dome-shaped configuration and method of making the same.

BACKGROUND OF THE INVENTION

Reflective pavement markers are well known to those skilled in the art. Most reflective pavement markers are generally comprised of a lens member of light-transmitting synthetic resin for reflecting light to indicate to a driver of a vehicle the relative position of the vehicle with respect to the road. Additionally, these pavement markers generally have one, or at most two, reflective lens members positioned such that the reflective portions thereof are oriented toward the intended direction through which traffic flows. Furthermore, most reflective pavement markers currently in use have box-like housings having inclined support walls.

Typical of such prior art pavement markers include Heenan, U.S. Pat. No. 3,332,327; Johnson, Jr. et al, U.S. Pat. Nos. 4,232,979 and 4,340,319; and Hedgewick, U.S. Pat. No. 5,002,424. As mentioned above, such prior art pavement markers incorporate one or more reflective lens members encased in a housing. However, the reflective members are generally positioned such that light is reflected in one direction and, as such, only reflect light back to the driver of a vehicle when the driver approaches the marker in a generally straight-forward manner. Accordingly, when such typical reflective markers are approached in directions other than straight-forward, such markers fail to provide the driver with the visual reflection that ideally indicates his or her relative position with respect to the road. In addition, the box-like housings of such reflective markers currently in use have complex structures that necessitate the use of complicated manufacturing procedures.

Accordingly, there is a need for a pavement marker that is capable of reflecting light back to an approaching vehicle regardless of the direction in which the vehicle approaches the marker. There is also a need for a pavement marker that is made of simple construction and durable materials that can further be manufactured by means of an effective and efficient method.

SUMMARY OF THE INVENTION

The present invention is directed to a light reflective pavement marker and method for manufacturing same. The pavement marker comprises a generally circular, reflective member having a smooth, upwardly sloping outer surface and a concentric circular aperture formed therein. A casing having a generally circular dome-shaped central portion extending upwardly through the aperture is molded about the reflective member such that a substantially unitary pavement marker is formed. Additionally, the light reflective pavement marker of the present invention is made of durable plastic materials suitable to withstand the forces commonly acted upon the pavement by traffic, weather, and other conditions.

In the preferred embodiment, the reflective member is comprised of a first circular member and a second circular back plate member, wherein each circular member has a generally concentric aperture formed therein. The first circular member forms the outer surface of the reflective member and has a plurality of facets formed therein for reflecting light. The facets are preferably arranged in segmented sections that are positioned about the first circular member. The first circular member additionally has a registry pin formed thereon.

The first circular member is preferably received upon the second back plate member. The second back plate member is shaped and designed to axially align with the first circular member and further has a pin-receiving member protruding therefrom for receiving the registry pin of the first circular member. By aligning the first and second members such that the registry pin is received within the pin-receiving member, the first and second members become non-rotatably fixed in position.

In the most preferred embodiment, the casing is molded about and within the first circular member and second back plate member as the first circular member and second back plate member are in this non-rotatable axial alignment. The casing sandwiches the first and second members such that the casing forms an annular base and a rounded dome portion about the first and second members. Additionally, the casing is molded such that a plurality of support members are formed within the interior portion of the casing so as to provide strength and support to the pavement marker.

The method of manufacturing the pavement marker of the present invention essentially comprises the steps of molding a casing about a circular reflective member. In the most preferred embodiment, the circular reflective member is first assembled by axially aligning the first circular member with the second back plate member and then molding the casing about the aligned first and second members. Preferably, the casing is molded about the members by means of an injection mold. In the most preferred method, a hot injection mold is used to form the casing whereby the injection into the mold occurs through an inlet positioned on a portion of the mold forming the bottom of the casing.

It is therefor an object of the present invention to provide a pavement marker that is capable of reflecting light when approached by a vehicle regardless of the direction in which the vehicle approaches the marker.

Another object of the present invention is to provide a road marker that is of durable construction that can withstand the forces acted on pavement surfaces.

Another object of the present invention is to provide a pavement marker that is of simple construction and that may be manufactured easily.

Another object of the present invention is to provide a method of manufacturing a pavement marker that is efficient and cost-effective.

BRIEF DESCRIPTION OF THE DRAWINGS

FIG. 1 is a perspective view of an upper portion of, a pavement marker according to a preferred embodiment of the present invention;

FIG. 2 is a perspective view of the bottom portion of the pavement marker;

FIG. 3 is a side view of the pavement marker;

DETAILED DESCRIPTION OF THE PREFERRED EMBODIMENTS

Figure 4:
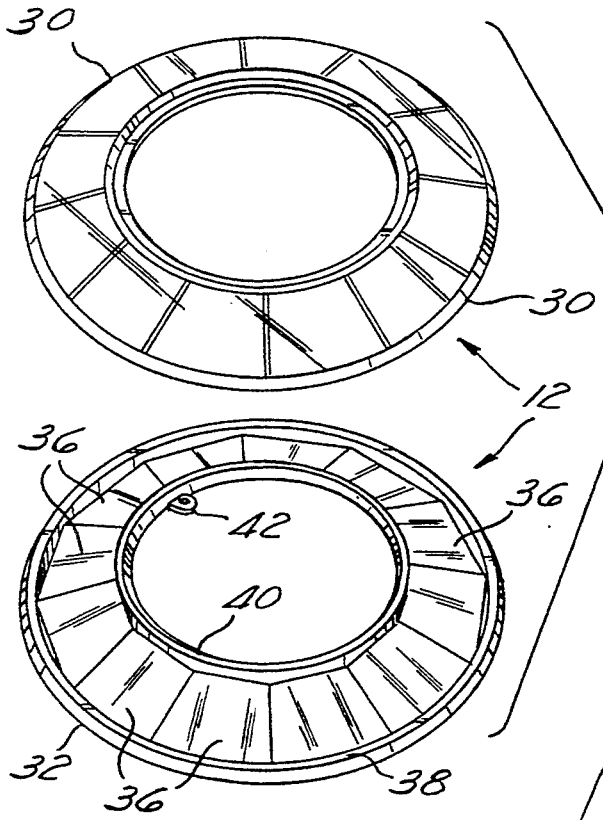
FIG. 4 is an exploded top view of a first circular member and a second back plate member of the pavement marker.

Referring to FIGS. 1–6, and more particularly to FIG. 1, there is shown a pavement marker 10 according to a preferred embodiment of the present invention. The top portion of the pavement marker 10 comprises a generally circular reflective member 12 having a casing 14 molded thereabout such that a smooth, dome-shaped pavement marker is formed. As illustrated, the casing 14 preferably has an upwardly sloping annular base 16 that is formed about the reflective member 12. Additionally, the casing 14 is formed such that a generally rounded dome-shaped portion 18 extends upwardly through the reflective member 12. These three visible portions, annular base 16, reflective member 12, and rounded dome portion 18, are formed to preferably have a smooth, dome-like shape that is well suited to withstand the rigorous forces, such as harsh weather conditions and the force of tires of moving vehicles, typically subjected on such pavement.

FIG. 2 depicts the bottom portion of the pavement marker 10 of the present invention. Formed within the casing 14 are a series of support members 20. Preferably, these support members 20 extend radially about the interior of the casing 14. Additionally, the casing 14 will further, have one or more circular support members 22 for providing additional strength and structure to the pavement marker 10. Exposed within the interior portion of the casing 14 is the bottom view of the reflective member 12 having a plurality of anchor pins 24, more clearly depicted in FIG. 5, that provide stability to the reflective member 12 as the casing 14 is formed about the reflective member 12.

Referring to FIG. 3, there is shown the preferably smooth, dome-like shape of the outer surface of the pavement marker 10. As illustrated, the pavement marker 10 has an upwardly-sloping surface preferably having the reflective lens member 12 positioned in a generally concentric manner therein. The reflective lens member 12 has a plurality of facets 26 for reflecting light. The facets 26 are preferably arranged in segmented sections 28 of generally symmetrical size, but may also be arranged in a continuous, non-segmented pattern. These segmented sections 28 of facets 26 are spaced about the reflective member 12 such that light will be reflected from the reflective member 12 when light, such as that emitted from the headlights of a moving vehicle, is shown upon its surface. Furthermore, the reflective member 12 is designed and positioned to reflect light at angles that are easily viewed from such vehicles that approach the pavement marker 10.

Advantageously, the circular configuration of the reflective member 12 provides reflection, and thus provides means for orienting the driver of a vehicle with respect to the vehicle's position in relation to the pavement, when the pavement marker is approached by a vehicle regardless of the direction in which the vehicle approaches the marker 10. Accordingly, the pavement marker 10 of the present invention provides greater reflective capability than pavement markers generally in use.

In the preferred embodiment, the reflective member 12 is comprised of a first circular member 30 and a second back plate member 32 as illustrated in FIG. 4. The first circular member 30 is preferably formed of a tough, clear plastic material, such as polycarbonate or some other suitable reflective material known to those skilled in the art, whereby the segmented sections 28 of facets 26 are formed therein. The outer surface of the first circular member 30 is smooth and slopes upwardly such that the outer surface of the pavement marker 10 has a continuously smooth, dome-shaped curvature. The first circular member 30, as well as the second back plate member 32, further has a concentric aperture 34 formed therein such that the rounded dome portion 14 may be formed therein and thereabout.

The second back plate member 32, which also is preferably fabricated from tough plastic materials known to those skilled in the art, is shaped and designed to axially align with the first circular member 30. The upper surface of the second back plate member 32 has a series of flat surfaces 36 for supporting the segmented sections 28 of facets 26 of the first circular member 30. Additionally, the second back plate member 32 has a first annular lip 38 and second annular lip 40 for supporting the first circular member 30 on top of the second back plate member 32. Furthermore, the second back plate member 32 has a pin-receiving member 42 formed thereon for receiving a registry pin formed on the first circular member 30. This registry pin, designated as 44, is more clearly depicted in FIG. 5.

Figure 5:
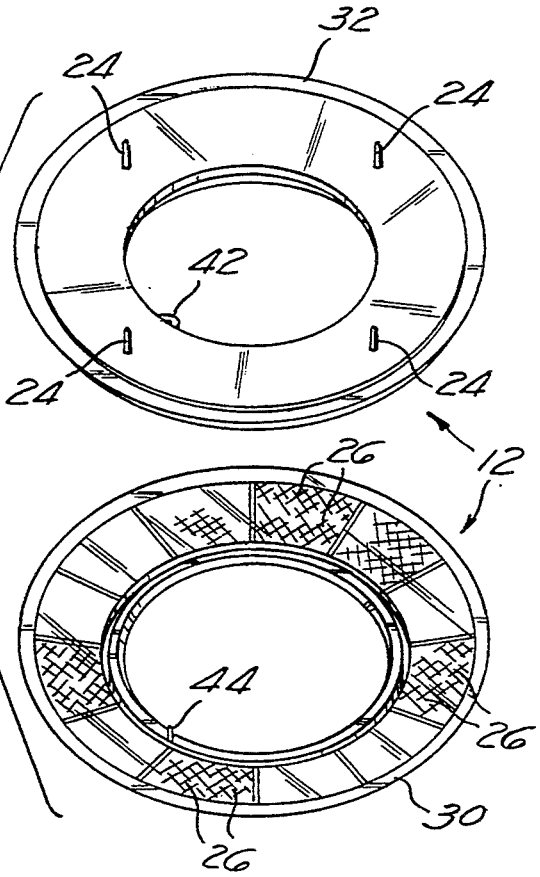
FIG. 5 is an exploded bottom view of the first circular member and second back plate member.

FIG. 5 illustrates the complimentary, axial alignment between the first circular member 30 and second back plate member 32 as viewed from a bottom perspective. As mentioned above, the segmented sections 28 of facets 26 of the first circular member 30 are received upon the top, portion of the second back plate member 32. The first circular member 30 also has a registry pin 44 formed thereon for engaging with the pin-receiving member 42 of the second back plate member 32. When the registry pin 44 is received within the pin-receiving member 42, the first circular member 30 and second back plate member 32 become rigidly and non-rotatably affixed to one another.

Figure 6:
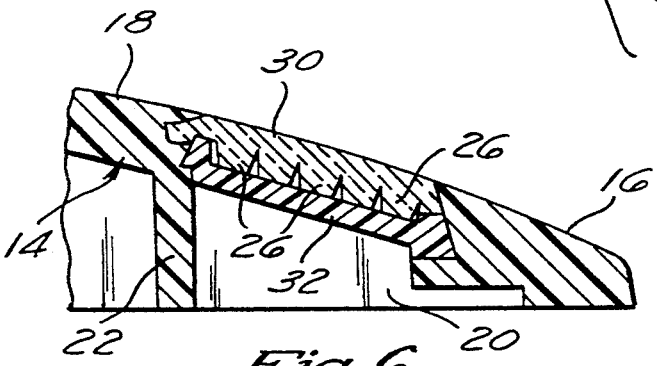
FIG. 6 is a cross-sectional view taken about line 6—6 of FIG. 1.

The first circular member 30 and second back plate member 32 are maintained in this rigid, non-rotatable configuration while the casing 14 of the pavement marker 10 is molded therein and thereabout. FIG. 6 depicts this structural arrangement between the first circular member 30, second back plate member 32, and casing 14 as these elements are combined to form the pavement marker 10. The casing 14 is formed, preferably by a hot injection mold within and about the first circular member 30 and second back plate member 32 such that these members are rigidly secured in position. The casing material, which is preferably methyl methacrylate or polycarbonate, provides means for fastening all of the elements of the pavement marker 10 into a single unit. Quite advantageously, the casing 14 is formed about the first circular member 30 and second back plate member 32 such that the casing material hardens and solidifies onto and about the interconnected first circular member 30 and second back plate member 32. Accordingly, no chemical adhesives or physical fastening means, other than the formation of the casing 14 about the interconnected members 30, 32, are necessary to form a rigid and durable road marker.

In order for the casing to form this rigid and durable arrangement, anchor pins 24, as depicted in FIG. 5, are provided upon the lower surface of the second back plate member 32. These anchor pins 46 serve to support the members 30, 32 as the casing is formed about and within the members 30, 32. Accordingly, the casing 14, upon hardening, becomes securely and rigidly affixed to the members 30, 32.

There has thus been provided a pavement marker having greater reflective capability than other pavement markers generally in use. Additionally, there is provided a pavement marker that is fabricated from simple yet durable materials that can withstand normal pavement-related forces.

In regards to manufacturing the pavement marker 10 of the present invention, a method is provided herein such that the pavement marker 10 may be produced in an effective and efficient manner. The method comprises the steps of providing a reflective member 12, as described above, and molding a casing 14 within and about the reflective member 12 such that the casing 14 and the reflective member 12 form a substantially unitary pavement marker.

With respect to the method of manufacturing the pavement according to the preferred embodiment, there is initially provided the first circular member 30 discussed above. The second back plate member 32, also discussed above, is additionally provided. These two respective members are then axially aligned such that the first circular member 30 is received upon the second back plate member 32. Further, the registry pin 44 formed on the first circular member 30 is received within the pin-receiving member 42 of the second back plate member 32.

Having axially aligned the two members, a casing 14 is then molded within and about the members in a dome-like configuration. Preferably, the casing is formed via a hot injection mold, which is well known to those skilled in the art, whereby the axially-aligned members are inserted into a base mold with the casing material being injected into the mold. Materials preferably used as a casing material include methyl methacrylate or polycarbonate. Additionally, the injection of the casing material into the mold is preferably carried out through an aperture formed on a portion of the mold forming the underside of the casing so as to minimize any disrupture of the formation of the smooth outer surface of the marker 10.

The mold that is used to set the casing about the axially-aligned members 30, 32 should be shaped and designed to allow the casing material to contact and solidify about and within the circumferential perimeters of the members 30, 32. By forming the casing 14 about the members in this manner causes the casing and members to form a rigid and durable structure. Additionally, molding the casing 14 about the members 30, 32 in the above-outlined manner provides means for forming a smooth, dome-shaped outer surface ideally suited for use as a pavement marker.

There has thus been provided a pavement marker suitable for engagement with an underlying roadway for providing a reflective visible marking from an oncoming vehicle on the roadway surface, regardless of the direction in which the oncoming vehicle is traveling. In addition, a method of producing the pavement marker of the present invention is provided herein.

It should be understood that various modifications within the scope of this invention can be made by one of ordinary skill in the art without departing from the spirit thereof. We therefor wish our invention to be defined by the scope of the appended claims as broadly as the art will permit, and in view of the specification if need be.

What is claimed is:

1. A pavement marker comprising:

a) a generally circular reflective member having an upwardly sloping outer reflective surface and a generally circular central aperture formed therewithin; and b) a casing having a generally circular dome-shaped central portion extending upwardly through the central aperture of said reflective member, said casing being molded to said reflective member such that said casing and said reflective member form a substantially unitary pavement marker.

2. The pavement marker of claim 1 wherein said generally circular reflective member comprises:

a) a first generally circular member having a smooth, upwardly sloping outer surface, said first circular member having a generally concentric circular aperture formed therein, said first circular member having at least one registry pin protruding therefrom and a plurality of facets formed therein for reflecting light, said plurality of facets being arranged in upwardly sloping segmented sections, said sections being positioned about said circular member; and b) a second generally circular back plate member having a concentric circular aperture formed therein, said second back plate member being shaped and designed to axially align with said first circular member, said second back plate member having an upper surface formed of a multiplicity of flat surfaces for supporting said segmented sections of facets of said first circular member, said second back plate member having at least one pin-receiving member protruding therefrom for receiving said at least one registry pin.

3. The pavement marker of claim 2 wherein said casing is molded about said first circular member and said second back plate member when said first circular member and said second back plate member are in axial alignment with one another, said casing being molded about said first circular member and said second back plate member when said registry pin is received within said pin-receiving member, said casing forming an upwardly sloping annular base and a rounded dome portion, said first circular member and said second back plate member being rigidly sandwiched between said annular base and said rounded dome portion, said rounded dome portion being formed within and around said apertures formed on said first circular member and said second back plate member, said casing being so molded that a series of support members are formed therein for supporting said road marker.

4. The pavement marker of claim 1 wherein the casing is formed from the group of materials consisting of methyl methacrylate and polycarbonate.

5. The pavement marker of claim 2 wherein said segmented sections of facets are generally symmetrical in size.

6. The pavement marker of claim 2 wherein the first circular member contains from 3 to 100 segmented sections of facets.

7. The pavement marker of claim 2 wherein the facets of the first circular member are arranged in a continuous, non-segmented circular pattern.

8. The pavement marker of claim 3 wherein the series of support members extend radially within the casing.

9. The pavement marker of claim 3 wherein the casing contains from 2 to 100 support members.

10. A method of manufacturing a pavement marker comprising the steps of:

a) providing a generally circular reflective member having an upwardly sloping outer reflective surface and a generally circular central aperture formed therein; and b) molding a casing within and about said generally circular reflective member such that said casing and said reflective member form a substantially unitary pavement marker.

11. The method of claim 10 wherein said generally circular reflective member is assembled prior to molding said casing, said assembly comprising the steps of:

a) providing a first generally circular member having a smooth, upwardly sloping outer surface, said first circular member having a concentric circular aperture formed therein, said first circular member having at least one registry pin protruding therefrom and a plurality of facets formed therein for reflecting light, said plurality of facets being arranged in upwardly sloping segmented sections, said sections being positioned about said circular member;

b) providing a second generally circular back plate member having a concentric circular aperture formed therein, said second back plate member being shaped and designed to axially align with said first circular member, said second back plate member having an upper surface formed of a multiplicity of flat surfaces for supporting said segmented sections of facets of said first circular member, said second back plate member having at least one pin-receiving member protruding therefrom for receiving said at least one registry pin; and c) axially aligning said first circular member with said second back plate member such that said first circular member is placed on top of said second back plate member, said first circular member being so placed upon said second back plate member such that said at least one registry pin is received within said at least one pin-receiving member.

12. The method of claim 11 wherein said casing is molded about and within said first circular member and said second back plate member such that said first circular member and said second back plate member become rigidly affixed to the casing.

13. The method of claim 12 wherein the casing is molded to form a generally circular, dome-like shaped pavement marker.

14. The method of claim 10 wherein the casing is molded from the group of materials consisting of methyl methacrylate and polycarbonate.

15. The method of claim 12 wherein the casing is formed about the first circular member and second back plate member in an injection mold.

16. The method of claim 15 wherein the injection into the mold occurs through an inlet positioned on a portion of the mold forming the bottom surface of the casing.

* * * * *